US008196352B2

(12) United States Patent
Mangold et al.

(10) Patent No.: US 8,196,352 B2
(45) Date of Patent: Jun. 12, 2012

(54) DRIVER FOR A WINDOW-RAISING DEVICE

(75) Inventors: Claus Mangold, Ottilien (DE); Marko Hermann, Eschwege (DE)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 428 days.

(21) Appl. No.: 12/297,224

(22) PCT Filed: May 25, 2007

(86) PCT No.: PCT/EP2007/055135

§ 371 (c)(1),
(2), (4) Date: Jan. 5, 2009

(87) PCT Pub. No.: WO2008/000569

PCT Pub. Date: Jan. 3, 2008

(65) Prior Publication Data

US 2009/0307977 A1 Dec. 17, 2009

(30) Foreign Application Priority Data

Jun. 30, 2006 (DE) ..... 10 2006 030 238

(51) Int. Cl.
*E05F 11/38* (2006.01)

(52) U.S. Cl. ..... 49/374; 49/352; 49/375

(58) Field of Classification Search ..... 49/352, 49/374, 375

See application file for complete search history.

(56) References Cited

U.S. PATENT DOCUMENTS 4,805,346 A * 2/1989 Gergoe ..... 49/352
5,848,496 A * 12/1998 Bertolini et al. ..... 49/352
6,131,339 A * 10/2000 Ramus ..... 49/375
6,205,711 B1 * 3/2001 Klippert ..... 49/375
6,233,873 B1 * 5/2001 Lawrie et al. ..... 49/375
6,418,668 B1 * 7/2002 Arquevaux ..... 49/352
6,598,345 B1 * 7/2003 Arimoto et al. ..... 49/374

(Continued)

FOREIGN PATENT DOCUMENTS

DE 10 2004 017 645 11/2005

(Continued)

OTHER PUBLICATIONS

International Preliminary Report on Patentability published Jan. 6, 2009 for PCT/EP2007/055135 filed May 25, 2007.

(Continued)

*Primary Examiner* — Katherine W Mitchell
*Assistant Examiner* — Justin Rephann
(74) *Attorney, Agent, or Firm* — Martin Fleit; Paul D. Bianco; Fleit Gibbons Gutman Bongini & Bianco PL

(57) ABSTRACT

The invention relates to a window lift system of a vehicle door with a first component, wherein the first component is designed for the fixation at a window, wherein the first component can be inserted with the window into a first position in the vehicle door, and with a second component, wherein the second component can be attached to the vehicle door in a detachable manner, wherein the second component is movable from the second position to the first position, and wherein the first component can be connected with the second component in the first position. In other aspects, the invention relates to a method for mounting of the lifter, a first component, and a second component. The invention further relates to a tool for mounting of the lifter.

17 Claims, 10 Drawing Sheets

U.S. PATENT DOCUMENTS

| | | | | |
|---|---|---|---|---|
| 6,729,073 | B2 * | 5/2004 | Nicolai | 49/375 |
| 6,796,085 | B2 * | 9/2004 | Smith | 49/352 |
| 6,810,623 | B2 * | 11/2004 | Messlez et al. | 49/374 |
| 2002/0050100 | A1 | 5/2002 | Tatsumi | |
| 2002/0109401 | A1 | 8/2002 | Ikeda | |
| 2003/0140562 | A1 * | 7/2003 | Staser et al. | 49/352 |
| 2004/0065018 | A1 * | 4/2004 | Regnier et al. | 49/352 |
| 2004/0154227 | A1 * | 8/2004 | Yoshimura | 49/352 |
| 2004/0194390 | A1 * | 10/2004 | Ishikawa et al. | 49/352 |
| 2008/0289256 | A1 | 11/2008 | Mangold | |
| 2009/0000202 | A1 | 1/2009 | Eckhardt | |

FOREIGN PATENT DOCUMENTS

| | | |
|---|---|---|
| DE | 10 2005 061 009 | 8/2007 |
| FR | 2 780 746 | 1/2000 |

OTHER PUBLICATIONS

Written Opinion of the International Search Authority published Dec. 31, 2008 for PCT/EP2007/055135 filed May 25, 2007.

English Translation of International Preliminary Report on Patentability published Jan. 13, 2009 for PCT/EP2007/055135 filed May 25, 2007.

English Translation of Written Opinion of the International Search Authority published Jan. 12, 2009 for PCT/EP2007/055135 filed May 25, 2007.

International Search Report published Jan. 3, 2008 for PCT/EP07/055135 filed May 25, 2007.

* cited by examiner

DRIVER FOR A WINDOW-RAISING DEVICE

FIELD OF THE INVENTION

The invention relates to a lifter for a window lift system, a method for the mounting of the lifter, a first and a second component of the lifter, and a tool for the mounting of the lifter.

BACKGROUND OF THE INVENTION

Window lift systems are used in vehicles to open or close windows in vehicle doors. Such known window lift systems have a drive and guidance device for drive and guidance of the window belonging to the window lift system. For this, the drive device is realized, for instance, as a cable pull mechanism that guides the window (actuated manually or electrically), for example, within rails that are located in the A, B, or C column.

For the conversion of a movement of the cable pulls to a lifting or lowering movement of the window, a so-called lifter is used. Both the cable pull on one hand and the window on the other hand are attached to the lifter so that by activation of the drive mechanism the window is moved along by the lifter.

The DE 10 2004 017 645 A1 relates to a window lift system, particularly for a side window of a vehicle, with a pulling device and a lifter for a window, capable of being moved upward or downward by this pulling device, wherein the lifter has a first attachment point for an upward pulling end of the pulling device and a second attachment point for a downward pulling end of the pulling device, offset horizontally in the plane of the window for a mounted window, wherein, additionally, the window lift system has means for positioning and fixation of the lifter at least relative to three degrees of freedom so that the lifter can be held in a defined position relative to these degrees of freedom even if the window is not mounted.

US 2002/0050100 A1 shows a window lift system with a lifter guided by a rail consisting of two parts. The first component has a reception slot for a window and has further means for fixation of the second component of the lifter. Additionally, the first component has means for reception of positioning means, and it can be mounted, together with the window, into the vehicle door. The second component is designed for fixation of the lifter at the rail and has means for temporary attachment of the second component at a vehicle door, particularly at a location along the rail in a second position. Additionally, the second component has means for reception of positioning means attached to the first component and means for attachment of the second component at the first component.

In DE 10 2005 061 009, which is not published at the time of application, a window lift system and a method mounting of the window lift system is described. The window lift system has a lifter for a window, an inner doorplate, and positioning means for positioning of the lifter relative to the inner doorplate in a mounting position for mounting of the window. For this purpose, the positioning means can take a first and a second position, wherein the positioning means in the first position define the mounting position and wherein the positioning means in the second position release a movement of the lifter for opening and closing of the mounted window. For the purpose of mounting the window, the lifter is held by the positioning means in the mounting position. The window is separately inserted into the door. The window features a hole by means of which the window can interlock with a receiver of the lifter. A disadvantage of the window lift system described in the document mentioned above is that the positioning means can only be used for the mounting of the window. After the mounting, the positioning means do not fulfill further functions.

SUMMARY OF THE INVENTION

The basis of the invention, therefore, is the task of defining an improved lifter for a window lift system and an improved method for mounting of the lifter.

The tasks that are the basis for the invention are each solved by the features of the independent Claims. Embodiments of the invention are defined in the dependent Claims.

According to the invention, a lifter is created for a window lift system of a vehicle door. To this end, the lifter has a first component. The first component is designed for attachment to a window and can be inserted together with the window into a first position in the vehicle door. In addition, the lifter has a second component. The second component can be installed in a second position at the vehicle door in a detachable manner. The second component can be moved from the second position to the first position, wherein the first component can be connected with the second component in the first position.

According to the invention, the first component is designed for attachment at the window, and the first component can be built into the vehicle door together with the window. For this, the window is built-in together with the first component so that the first component is located in a first position in the vehicle door. The second component of the lifter can be installed in a second position at the vehicle door in a detachable manner. After the first component is then brought into the first position, the attachment of the second component at the vehicle door is detached, and the second component is moved from the second position into the first position. The first component is connected with the second component in the first position. The lifter, according to the invention, has the advantage that it can be assembled in situ, meaning in the vehicle door, with its first and second components. A positioning means, such as it is described in the state of the art, is not any longer required. This simplifies the installation and reduces the installation cost since the cost for the positioning means are omitted. An additional advantage of the lifter according to the invention is that it can be disassembled relatively easily in the case of a necessary change of the window. In this case, the window can be removed from the vehicle door together with the first component and be replaced by a new window.

According to an embodiment of the invention, the second component has a receptacle for a tool, wherein the second component is movable from the second position to the first position by using this tool. The tool, therefore, serves for moving the second component from the second position into the first position.

According to an embodiment of the invention, the second component of the lifter has at least one receptacle for at least one cable of the window lift system. The second component, therefore, serves for the attachment of at least one cable of the window lift system. Normally, two cables or the two cable ends of a circular cable of the window lift system are attached to the second component in order to move the window up or down in the door with it.

According to an embodiment of the invention, the vehicle door has a door module, wherein the second component is installed in the second position at the door module. Additionally, the door module has an opening through which the second component can be reached from that side of the door that is on the opposing side of the first and second position, and into which a tool can be inserted from the opposite side of the door in order to move the second component from the second position to the first position. In this case, the door module may consist entirely or partially of plastics or sheet metal.

According to an embodiment of the invention, the second component has means for positioning the first component in the first position. The second component is attached in the second position in a detachable manner. By the means for positioning the first component, which are attached to the second component in a detachable manner, the first position is defined. The first component, which is inserted into the vehicle door together with the window, will then be held in the first position based on the means for positioning.

According to an embodiment of the invention, the means for positioning are connected to the second component in a detachable manner. The detachable connection of the means for positioning the first component with the second component has the advantage that the first position can be defined by the location of the second position and, therefore, by the location of the first component in its original position. This ensures that the second component can always be moved from the second position into the first position in the same way. This is particularly important in the case that the movement of the second component from the second position into the first position is done by means of a robot.

According to an embodiment of the invention, the first component has a receptacle for the means for positioning. The first component, therefore, can receive the means for positioning at least partially and, thus, enter into the first position.

According to an embodiment of the invention, the first component is glued to the window or the first component is locked in position by means of a hole in the window.

According to an embodiment of the invention, the first component and the second component can be screwed to or locked together.

According to an embodiment of the invention, the window protrudes beyond the door trim molding of the door if the first component is located on the first position. For a completely or almost completely lowerable window, the window in its completely opened position does not or almost does not protrude beyond the door trim molding so a mounting in the completely opened position is difficult. The first position for the first component is now selected in a way that the window protrudes beyond the door trim molding of the door, even if the window lift system is of the type with a large glass drop, particularly with a glass drop of 100 percent. In the mounting position, therefore, the segment of the window protruding beyond the door trim molding of the door can easily be grasped so that the mounting of the window and the lifter is substantially simplified.

According to an embodiment of the invention, the first and the second position are at the height of a middle area of the door module. The second component is ideally attached in the middle area of the door module in the second position in a detachable manner. The door module must have a relatively large opening for the mounting of the first and the second component. Since an opening in the middle area of the door module does not lead to a reduction in the stability or the strength of the door module, this area is particularly well suited for the mounting of the lifter.

According to an embodiment of the invention, the second component is movable from the second position to the first position by a movement that runs essentially perpendicularly to the movement direction of the installed window. The first position, therefore, is also accessible through the opening in the inner door sheeting. Consequently, the first and second components can be mounted through the opening in that side of the door module that is located on the opposite side of the door module.

According to an embodiment of the invention, the first component and the second component consist essentially of plastics.

In another aspect, the invention relates to a method for mounting of a lifter of a window lift system in a vehicle door. For this, the method according to the invention shows the attachment of a first component of the lifter at a window. In addition, the window is inserted into the vehicle door, wherein the first component is brought into a first position. Additionally, a positioning of a second component of the lifter is done at a second position of the vehicle door. In a further step, the first component is repositioned from the second position to the first position. In the first position, the first and the second components are connected with each other.

In a further aspect, the invention relates to a first component for a lifter of a window lift system of a vehicle door with means for attachment to a window, with means for attachment of a second component of the lifter, and with means for reception of positioning means of the second component. This includes a first component, whereby the first component can be mounted with the window into the vehicle door. This has the advantage that the first component can be attached to the window, for instance, by a glue connection, even before the mounting of the window. The first component is connected to the second component in situ. The installed window can then be dismounted particularly easily since, for dismounting, only the first component must be separated from the second component and then the window with the first component can be removed from the vehicle door.

In a further aspect, the invention relates to a second component for a lifter of a window lift system of a vehicle door with means for the temporary installation of the second component at a vehicle door in a second position, with means for positioning of a first component in a first position after installation of the second component in the second position, and with means for attachment of the second component to the first component.

In a further aspect, the invention relates to a tool for the mounting of a lifter of a window lift system of a vehicle door, wherein the lifter has a first and a second component, wherein the first component, attached to a window, can be installed in a first position in a vehicle door, wherein the second component can be installed in a second position in the vehicle door in a detachable manner, and wherein the tool has means for moving the second component from the second position to the first position. Additionally, the tool has means for holding the second component, wherein the means for holding locate the second component in a way that the alignment of the second component in the plane perpendicularly to an axis is maintained during relocation, wherein the axis is defined by the first and the second position.

BRIEF DESCRIPTION OF THE DRAWINGS

In the following, embodiments of the invention are explained by reference to the drawings. It is shown by.

DETAILED DESCRIPTION OF THE INVENTION

Corresponding elements of the embodiments described hereafter are marked with the same reference number.

Figure 1:
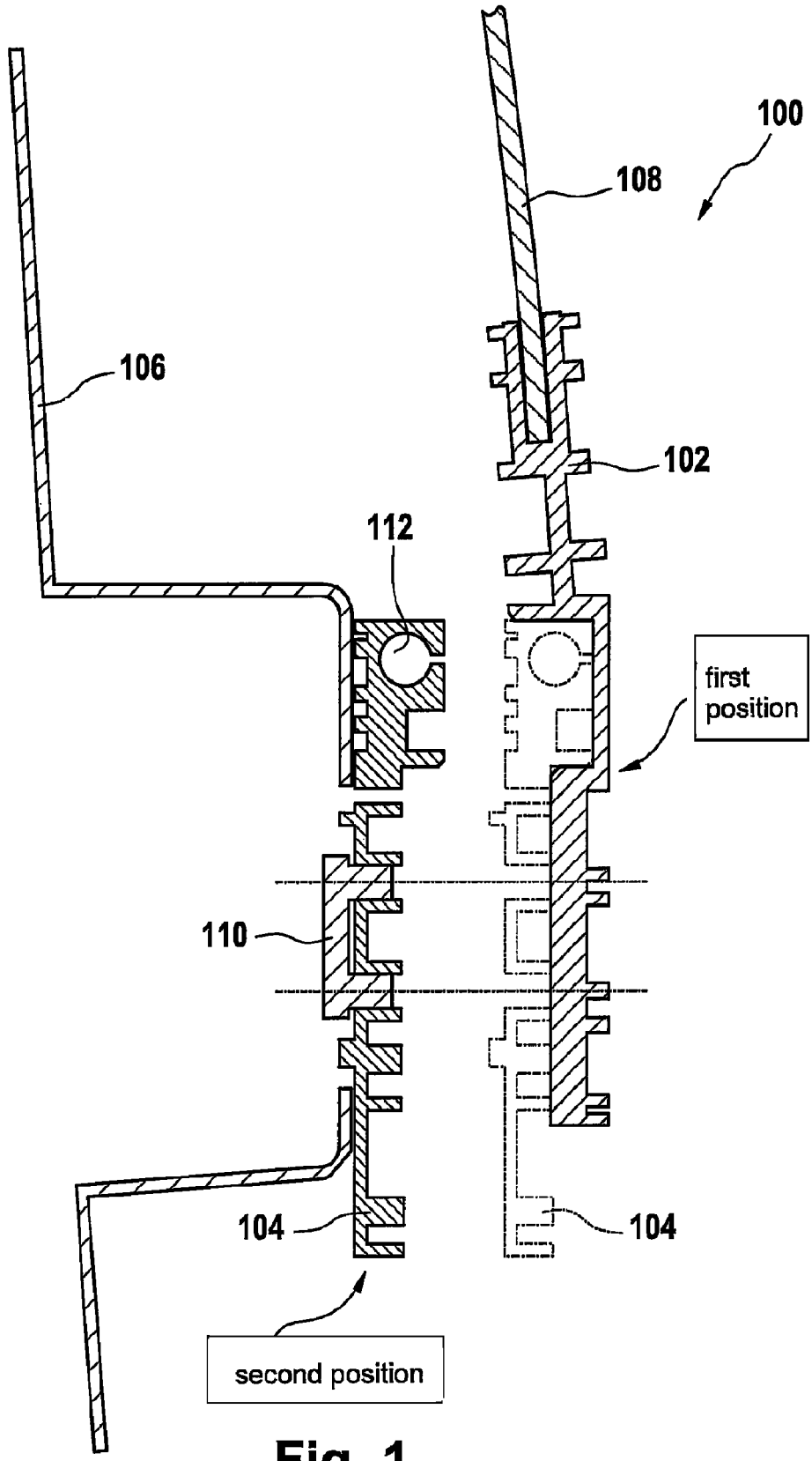
FIG. 1 a side view of a section of a window lift system.

FIG. 1 shows a side view of the section of window lift system 100. In this, the window lift system 100 has a first component 102 of the lifter and a second component 104 of the lifter. Additionally, the window lift system 100 contains window 108. For mounting of the window lift system 100 in a vehicle door, first component 102 is attached to door module 106 of the vehicle door in a second position, e.g., by a screw connection. The first component 102 is attached to the window 108 and inserted into the vehicle door together with the window 108 so that the first component 102 is located in a first position.

The attachment of the second component 104 at the door module 106 is loosened, and the second component 104 is moved from the second position to the first position. The first component 102 is then connected with the second component 104 in the first position by using, for instance, screws or clip connections.

The second component 104 has receptacle 112 for a cable of the window lift system. Typically, the second component 104 additionally has an extra receptacle for the cable that is located in the lower area of the second component 104. The cable is, for instance, a revolving cable, wherein one end of the cable is located in the receptacle 112 and the other end of the cable is located in the additional receptacle. According to the rotational direction of the cable, the cable pulls on the lifter through the fixation at the receptacle 112 or through the fixation at the additional receptacle and thus moves the window 108 upward or downward. Ideally, the cable ends are fixed in the corresponding receptacles when the second component 104 is in the second position, i.e., when the second component is attached to door module 106. After detaching of the second component 104 from the door module 106, the second component 104 rotates in the plane perpendicular to the drawing plane of FIG. 1 because of the pulling forces that are applied by the cable to the second component. In order to counter the pulling forces, tool 110 is used, which allows the engagement of the second component 104. During this, the second component 104 is engaged from the opposite side of the first component 102. For this purpose, the door module has a corresponding opening. The tool 110 can additionally be used to move the second component from the second position to the first position. By using the tool, it is ensured that the second component 104 does not rotate in the plane perpendicular to the drawing plane, so it can then be connected, as designed, with the first component 102. The tool 110 will be described in more detail further below. It can be engaged, for instance, with the second component 104 by a robot, and this robot then guides the second component from the second position to the first position by means of the tool.

Figure 2:
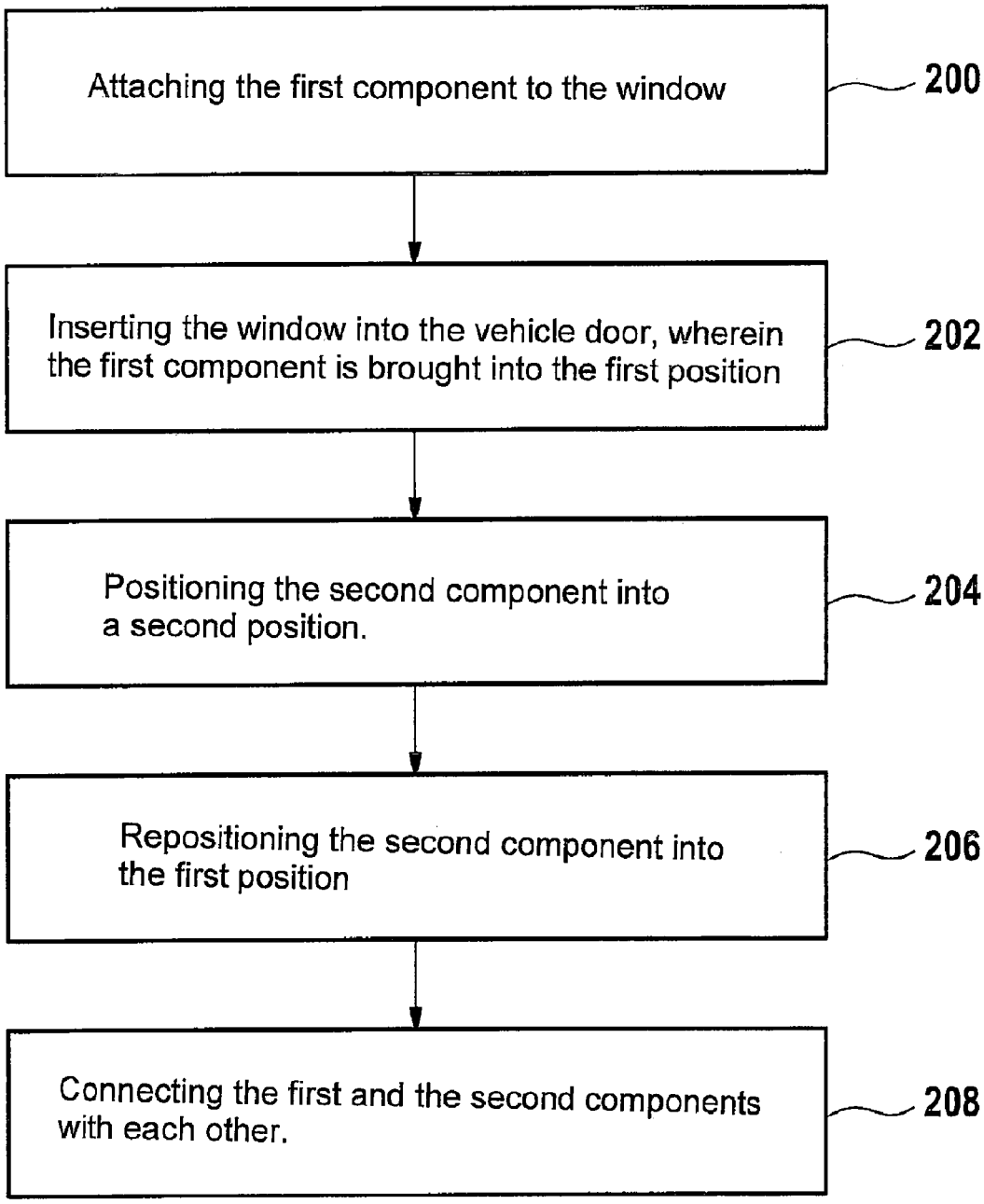
FIG. 2 a flow diagram showing important steps of the method according to the invention, FIG. 3 a side view of a section of a window lift system, FIG. 4 a perspective view of a door module in which the second component is installed in the second position, FIG. 5 a perspective view of the second component in the second position and of the first component in the first position, FIG. 6 the lifter according to the invention with the first and the second components in the first position, FIG. 7 a possible embodiment of a first component according to the invention, FIG. 8 a possible embodiment of a second component according to the invention, FIG. 9 a perspective view of the first and second component and the tool for mounting, FIG. 10 a possible embodiment for the mounting tool.

FIG. 2 shows, in a flow diagram, essential steps of the method according to the invention for mounting of a lifter of a window lift system in a vehicle door. In step 200, the attachment of a first component of the lifter to a window is done. In step 202 follows the insertion of the window into the vehicle door, wherein the first component is brought into a first position. The positioning of a second component of the lifter at a second position of the vehicle door then follows, in step 204. In step 206, the repositioning of the second component from the second position to the first position is done, and in step 208, the first and the second components are connected with each other.

Figure 3:
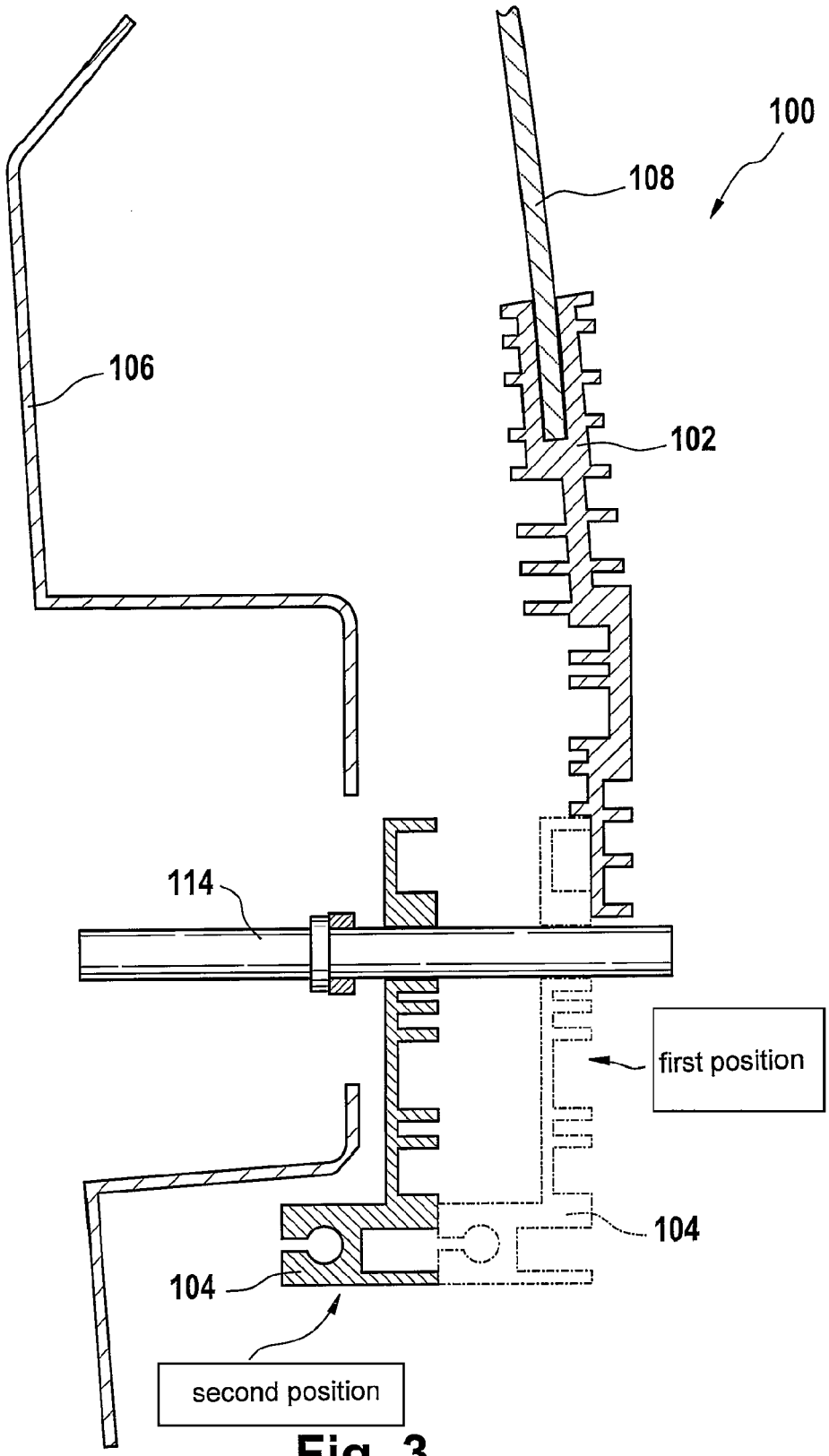

FIG. 3 shows a side view of a section of the window lift system 100. Pin 114 is inserted into the second component 104, which protrudes through the second component. For this purpose, the second component 104 contains a (accurately fitting) boring (not shown in FIG. 3) that is able to receive pin 114. The pin 114 serves for positioning of the first component 102 in the first position. During insertion of the window 108 with the first component 102, the window 108 and the first component 102 can be lowered into the door far enough until the first component 102 interacts with the pin and, therefore, cannot be lowered further into the door. The pin 114, therefore, holds the first component 102 in the first position. By installing the pin 114 at the second component 104, which itself is attached in the second position at door module 106, the first position for the first component 102 is thus defined. The window and the first component are also not able to move in the direction that is defined by the longitudinal axis of the pin 114, since the window is held in this direction, for instance, by guide rails. The second component 104 can now be moved along the pin 114 from the second position to the first position. This can be accomplished, for instance, by a robot that holds the pin 114 and pushes the second component along the pin 114 into the first position. In the first position, first component 102 and second component 104 are then connected with each other. Afterwards, the pin 114 can be removed.

Figure 4:
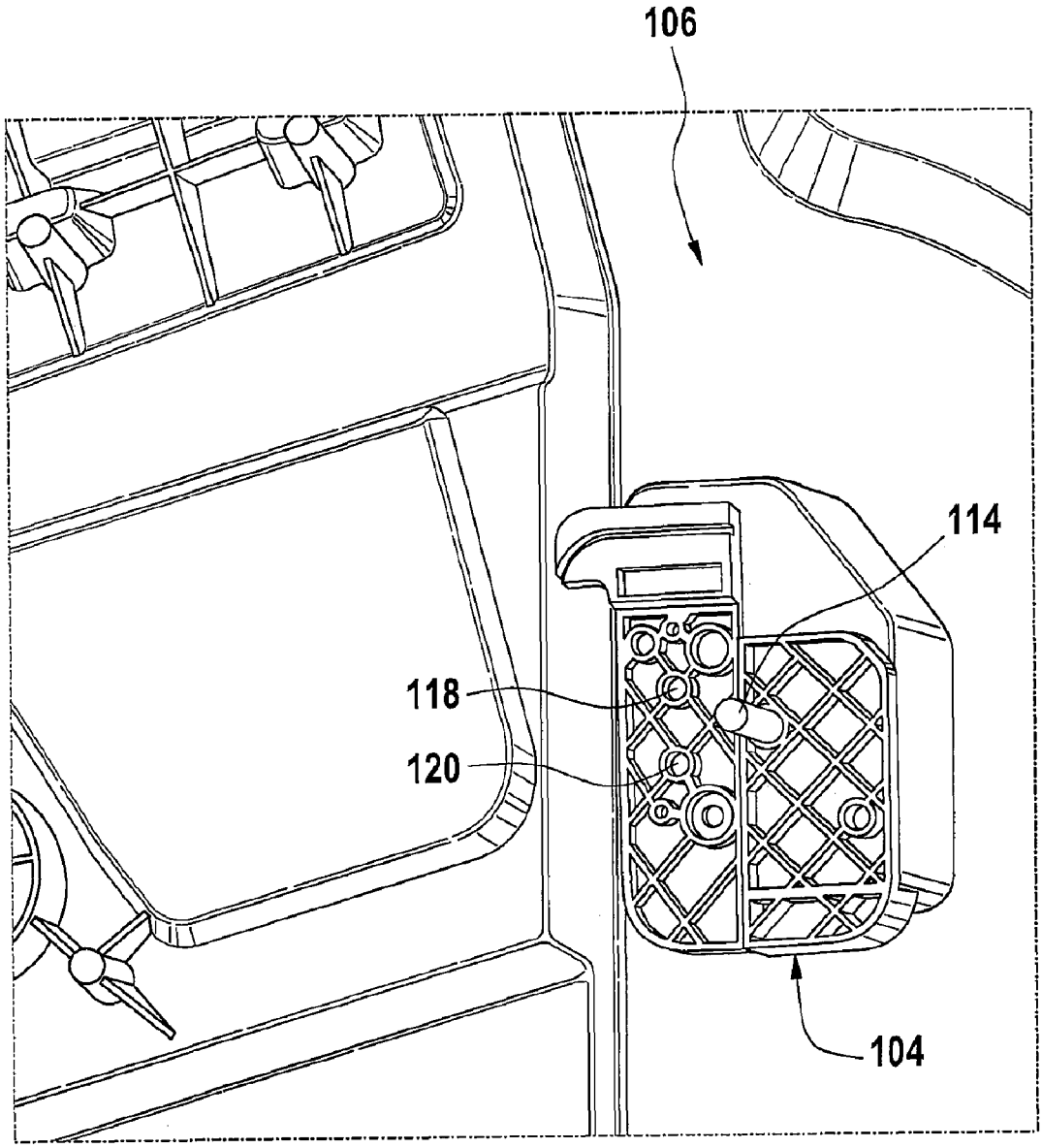

FIG. 4 shows a perspective view of the door module 106, at which the second component 104 is installed in the second position. For this, the door module 106 is itself a component of the vehicle door in which, for instance, the window lift system is located. As can be seen in FIG. 4, the second component 104 is installed at the door module. The pin 114, which is used for positioning of the first component in the first position, sticks out from the drawing plane of FIG. 4. Additionally, the second component 104 has two boreholes 118 and 120. The boreholes 118 and 120 serve for reception of the tool 110 described above with which the second component 104 can be moved without being able to rotate as a consequence of forces that are applied to the second component 104 by cables attached to second component 104.

Figure 5:
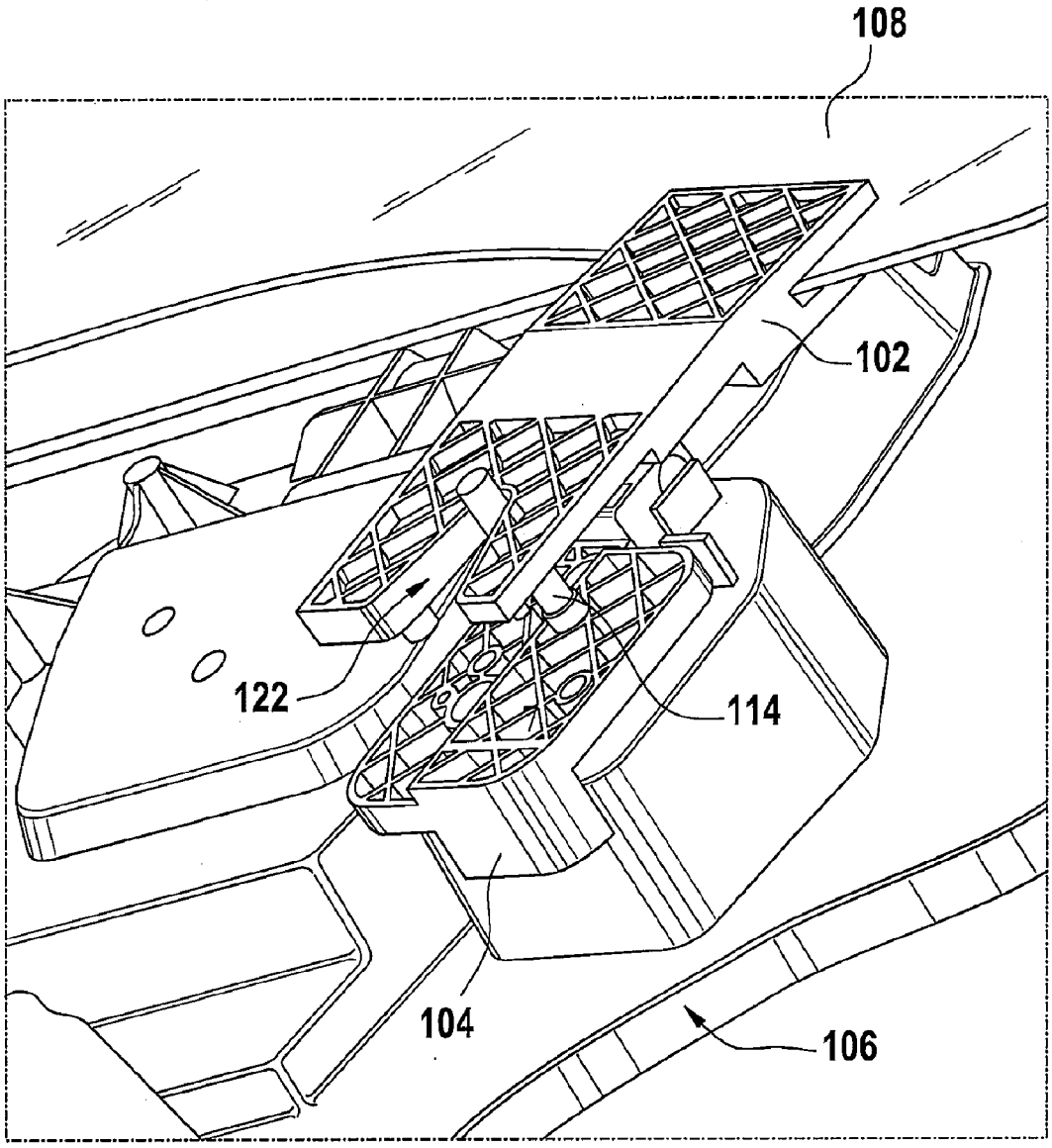

FIG. 5 shows a perspective view of the first component 102 in the first position and of the second component 104 in the second position. As described above in FIG. 4, the second component 104 is attached to the door module 106 in the second position. The pin 114 is attached to the second component 104. The first component is installed in the vehicle door together with the window 108. During the installation of the window 108 with the first component 102, it is lowered into the door until recess 122 in the first component interacts with the pin, which prevents further lowering of the window into the door. As shown in FIG. 5, the first component 102 is positioned opposite to the second component 104. The second component 104 can now be moved from the second position to the first position by a movement that essentially runs perpendicularly to the direction of movement of the window. The first component 102 and the second component 104 can then be connected with each other, for instance, by screws or by means of a clip connection. The pin 114 is then removed.

Figure 6:
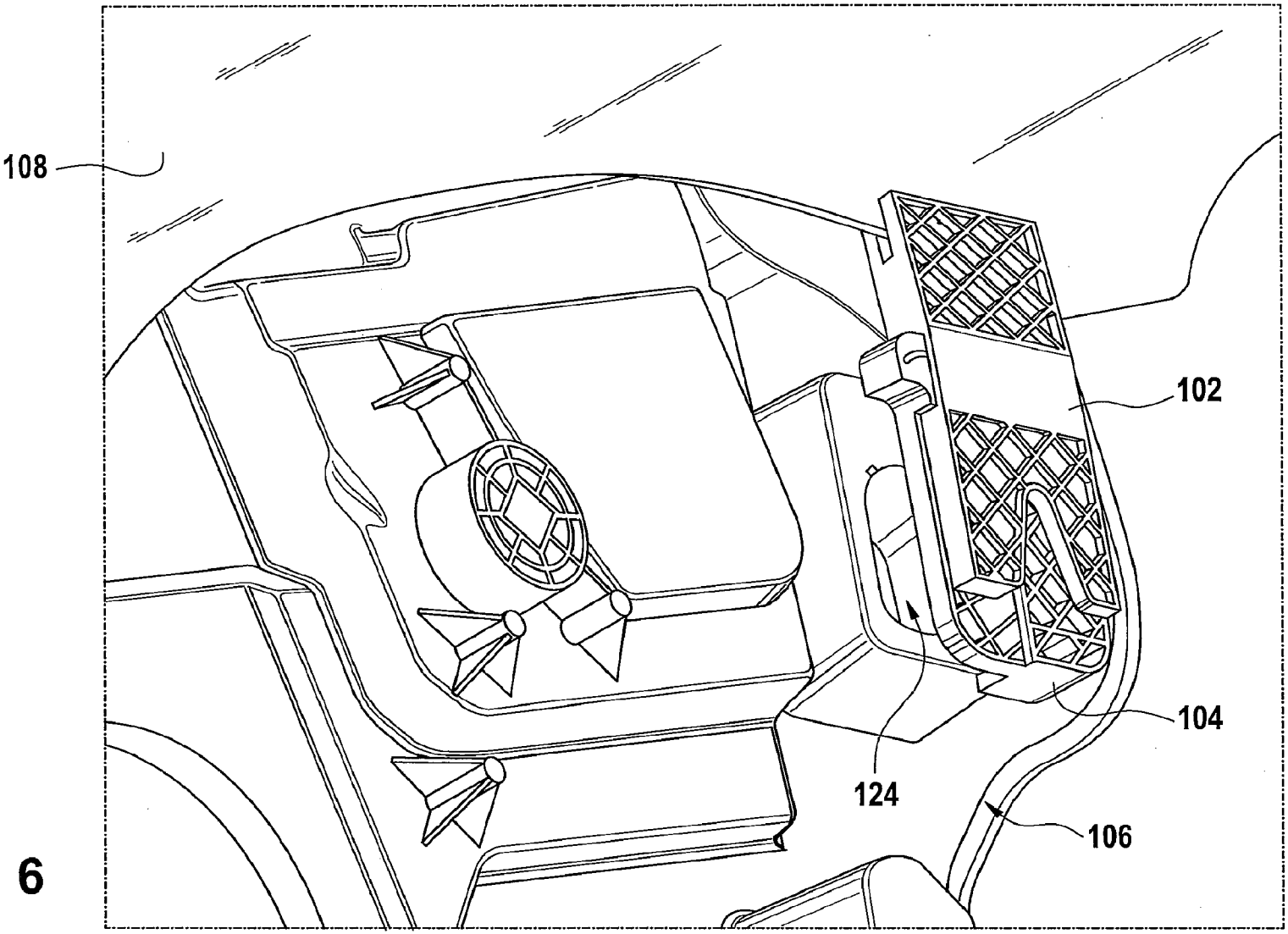

FIG. 6 shows the connected first and second components 102 and 104 in the first position. It can be recognized in FIG. 6 that the door module 106 has an opening 124 that allows the engagement of the second component 104 with the tool described before from the side located behind the door module 106, moving the second component from the second position into the first position as shown here.

Figure 7:
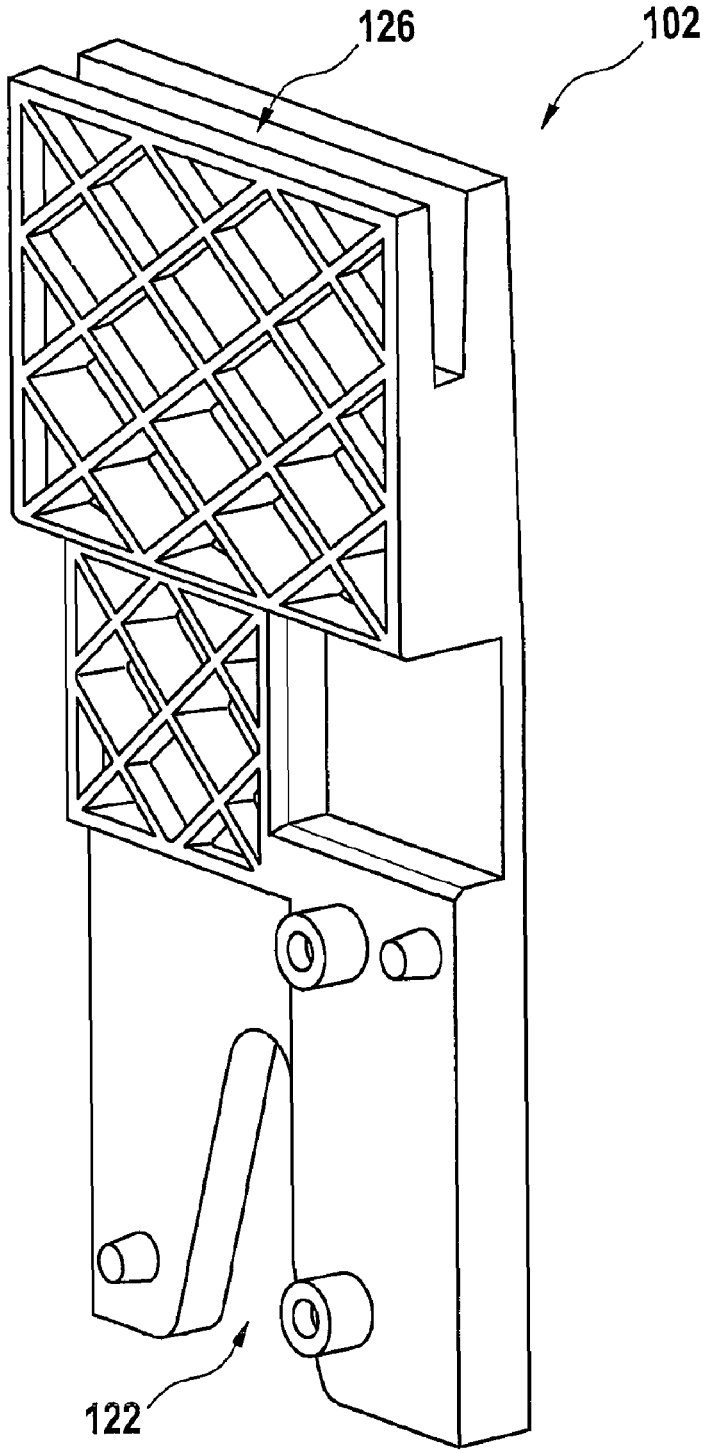

FIG. 7 shows an embodiment of the first component 102 according to the invention. The first component 102 has, in this case, receptacle slot 126 for the window. The receptacle slot 126 serves for reception of the lower rim of the window, wherein the lower rim can be glued, for instance, into the receptacle slot 126. Alternately, the receptacle slot can have means for formation of a locked connection. In addition, the lower rim of the window can have a hole into which the means for the formation of a locked connection engage, wherein the first component 102 is fixed to the window. Additionally, the first component 102 has the recess 122 that can partially receive the pin 114.

Figure 8:
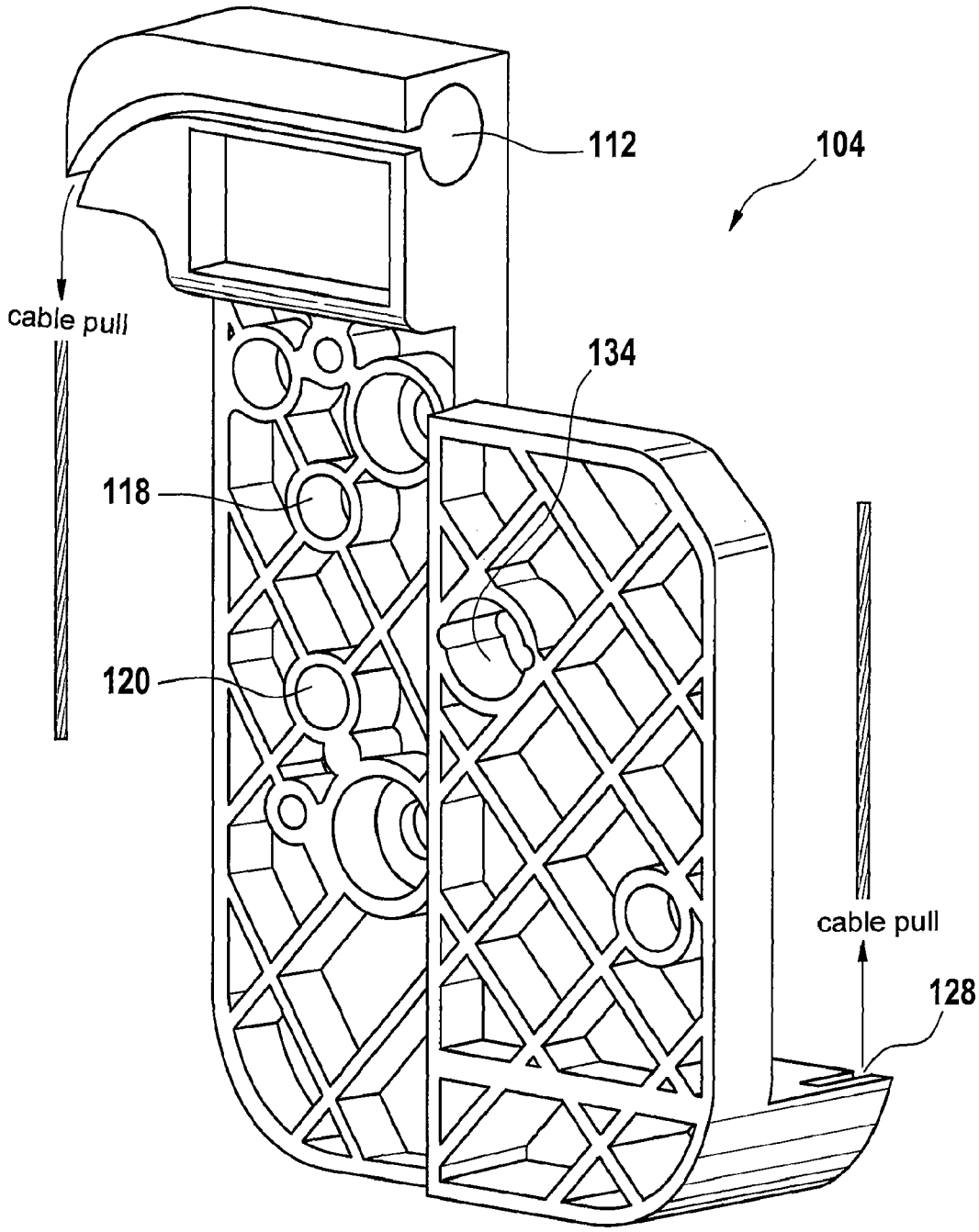

FIG. 8 shows an embodiment of the second component 104 according to the invention with the receptacle 112 and additional receptacle 128 for a cable of the window lift system. This is generally a revolving cable whose one end is fixed in the recess 112 and whose other end is fixed in the recess 128. Based on the geometrical position of the recesses 112 and 128 relative to each other, the second component 104 tries to orient itself correspondingly to the relationship of forces transferred to the recesses 112 and 128 by the two ends of the cable. In order to be able to keep the second component 104 in its designed orientation after detaching the second component from its fixation at the vehicle door, the second component has, in addition, as mentioned previously, the boreholes 118 and 120. It is possible to engage the tool into the boreholes 118 and 120 for mounting purposes, wherein the forces transferred by the cable ends can be compensated through the tool and by which the second component 104 can be moved from the second position to the first position, as described before. Additionally, the second component 104 has (accurately fitting) borehole 134. The borehole 134 serves, as mentioned already in the description of FIG. 3, for the reception of the pin.

Figure 9:
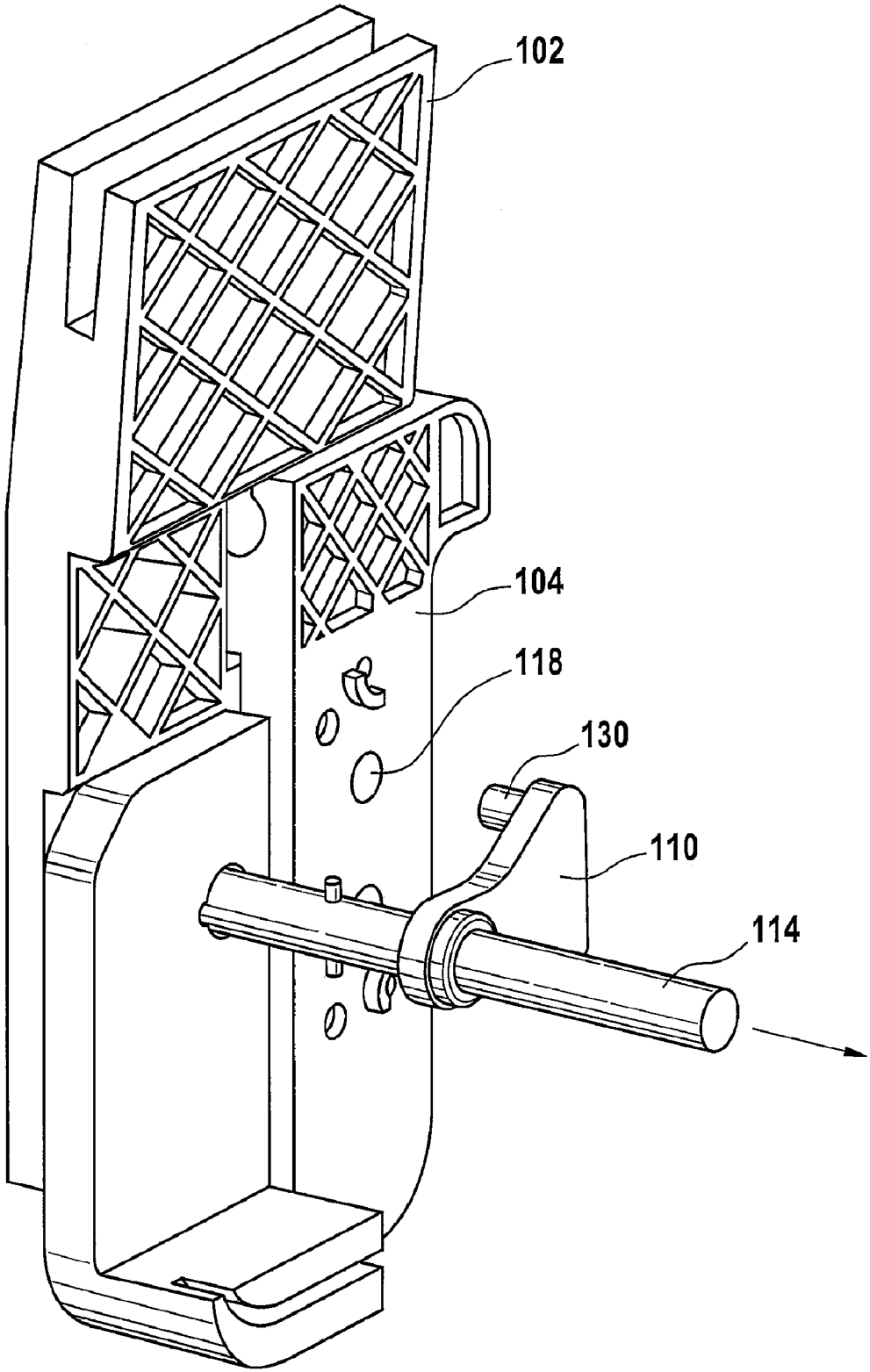

FIG. 9 shows a perspective view of the first and second components 102 and 104 and of the tool 110 for mounting. In this context, the tool 110 has the pin 114. The pin 114 penetrates through the second component 104 and defines, as described before, the first position for the first component 102. In addition, the tool 110 has two bolts, wherein only bolt 130 is visible in FIG. 9. The bolt 130 engages the borehole 118 when the pin is inserted into the second component until the stop position. The other, not visible bolt engages at the same time in another borehole that is also not visible. The other borehole and the other bolt are located slightly below the borehole 118 and the bolt 130. The second component 104 is then brought from the second position into the first position, where the second component 104 is connected with the first component 102, as shown in FIG. 9. By using the tool 110, the pin 114 is then removed from the lifter that is formed by assembly of the first component 102 with the second component 104. The corresponding movement direction for removal of the pin 114 is indicated by the arrow in FIG. 9.

Figure 10:
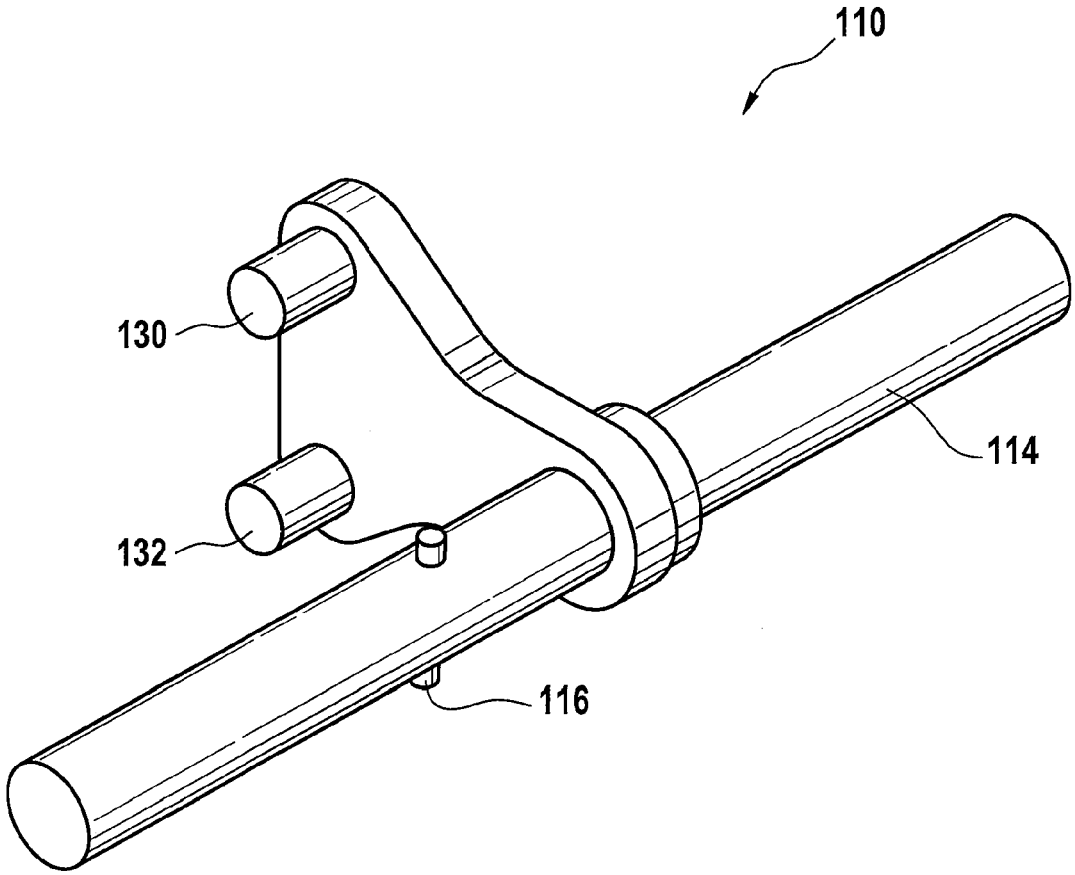

FIG. 10 shows the tool 110 for mounting of the lifter. The tool 110 includes the pin 114, as well as bolts 130 and 132. As mentioned before, the pin 114 serves for positioning of the first component in the first position if it is fixed correspondingly to the second component. The bolts 130 and 132 of the tool 110 engage in the boreholes 118 and 120 of the second component. During the repositioning of the second component from the first position to the second position, a torque can be applied to the pin 114 (for instance, by a robot) so that it can be ensured that the second component does not rotate, caused by forces applied by the cables of the window lift system. The second component can then be moved by the tool 110 from the second position to the first position. In addition, the the pin 114 has another, second pin 116 that penetrates the pin 114 laterally to the longitudinal axis of the pin 114. The tool 110 is guided through the borehole 134 (see FIG. 8) with the corresponding alignment of the second pin 116. For this, the borehole 134 has notches (shown schematically in FIG. 8) that are complementary to the second pin 116, so that the pin 114 can only be guided through the borehole 134 upon corresponding position of the second pin 116 relative to the notches. If the second pin 116 is located behind the borehole 134, as seen from the direction of movement, then the bolts 130 and 132 can be inserted into the boreholes 118 and 120 of the second component 104 by rotating the pin 114 around its longitudinal axis. Because of the rotation of the pin 114, the second pin 116 is then in a position that no longer allows the second pin 116 to be pulled out of the borehole 134. This can prevent, for instance, the second component 104 from detaching from the pin 114 during the movement from the second position to the first position.

REFERENCE LIST

100 window lift system
102 first component
104 second component
106 door module
108 window
110 tool
112 receptacle for cable pull
114 pin
116 pin
118 borehole
120 borehole
122 recess
124 opening
126 receptacle slot
128 receptacle for cable pull
130 bolt
132 bolt
134 borehole

The invention claimed is:

1. A lifter for a window lift system of a vehicle door for selectively lowering and raising a vehicle window in the vehicle door, the lifter comprising:

a first component having a slot operative to receive the window, the first component with the received window insertable into a first position in the vehicle door; and a second component discrete from the first component and removably attachable to the vehicle door in a second position and movable from the second position into the first position when unattached from the door, the second component including a first receptacle for fixedly receiving a first end portion of a cable of the window lift system and a second receptacle for fixedly receiving a second end portion of the cable of the window lift system, wherein the first and second receptacles are positioned relative to each other in a non-linear fashion such that when detached from the vehicle door and moved from the second position to the first position, the second component maintains a designed orientation; and wherein the first component is connectable with the second component in the first position.

2. The lifter of claim 1, wherein the second component includes at least one recess for a tool, the second component movable from the second position to the first position by using the tool.

3. The lifter of claim 1, wherein the vehicle door has a door module, the second component attached at the door module in the second position.

4. The lifter of claim 1, wherein the second component has means for positioning the first component in the first position.

5. The lifter of claim 4, wherein the means for positioning is connected to the second component in a detachable manner.

6. The lifter of claim 4, wherein the first component has a recess for partial reception of the means for positioning.

7. The lifter of claim 4, wherein the first component is glued to the window or wherein the first component is locked with a hole in the window.

8. The lifter of claim 4, wherein the first component and the second component are screwed together or are locked together.

9. The lifter of claim 4, wherein the window protrudes beyond a door trim molding of the door when the first component is positioned in the first position.

10. The lifter of claim 4, wherein the second component can be moved from the second position into the first position by a movement that runs essentially perpendicular to the movement direction of the window.

11. The lifter of claim 4, wherein the second component has a first face and a second face opposite the first face and wherein the first receptacle is located closer to the first face than the second face and the second receptacle is located closer to the second face than the first face.

12. A method for mounting of a lifter of a window lift system for selectively lower and raising a vehicle window in a vehicle door, the method comprising the steps of:

providing the lifter of claim 1;

attaching the first component of the lifter to the window;

inserting the window into the vehicle door, wherein the first component is brought into a first position;

positioning the second component of the lifter at a second position at the vehicle door;

repositioning the second component from the second position to the first position; and connecting the first and second components.

13. The method of claim 12, wherein the second component has means for positioning of the first component in the first position, wherein the means for positioning are removed after connection of the first and second components.

14. The method of claim 12, further comprising the step of attaching at least one cable of the window lift system at the second component.

15. The method of claim 12, wherein a tool is used for the repositioning of the first component.

16. The method of claim 12, wherein the second component can be moved from the second position to the first position by a movement that essentially runs perpendicular to the direction of the movement of the window.

17. A tool for mounting the lifter of claim 1, the tool comprising:

means for repositioning the second component from the second position to the first position; and means for holding the second component so that, during repositioning, the second component remains in the designed orientation.

* * * * *